US006583695B1

(12) United States Patent
Pfab et al.

(10) Patent No.: US 6,583,695 B1
(45) Date of Patent: Jun. 24, 2003

(54) HOUSING FOR SWITCHGEARS

(75) Inventors: Hans Pfab, Hahnbach (DE); Manfred Schmidt, Ursensollen (DE); Norbert Zimmermann, Sulzbach-Rosenberg (DE); Norbert Sörgel, Amberg (DE); Peter Donhauser, Schwandorf (DE)

(73) Assignee: Siemens Aktiengesellschaft, Munich (DE)

( * ) Notice: Subject to any disclaimer, the term of this patent is extended or adjusted under 35 U.S.C. 154(b) by 508 days.

(21) Appl. No.: 09/051,506

(22) PCT Filed: Oct. 10, 1996

(86) PCT No.: PCT/DE96/01933

§ 371 (c)(1),
(2), (4) Date: Jul. 27, 1998

(87) PCT Pub. No.: WO97/14166

PCT Pub. Date: Apr. 17, 1997

(30) Foreign Application Priority Data

Oct. 12, 1995 (DE) ..... 195 38 056
Sep. 18, 1996 (DE) ..... 196 38 142

(51) Int. Cl.[7] ..... H01F 1/00; H01F 3/00; H01F 7/00

(52) U.S. Cl. ..... 335/277; 335/132

(58) Field of Search ..... 335/106, 127–132, 335/202, 257, 277, 278

(56) References Cited

U.S. PATENT DOCUMENTS 4,229,719 A * 10/1980 Lemmer ..... 335/132
4,647,886 A * 3/1987 Schmiedel et al. ..... 335/132
5,623,239 A * 4/1997 Sitar ..... 335/132

FOREIGN PATENT DOCUMENTS

DE 41 23 369 4/1993
EP 660 355 6/1995

* cited by examiner

*Primary Examiner*—Ramon M. Barrera
(74) *Attorney, Agent, or Firm*—Harness Dickey & Pierce PLC

(57) ABSTRACT

To reduce the rebound of the main armature with contact carrier in response to the switching operation of a contactor, magnetic-chamber base of contactor housing is provided with two support areas for the magnet yoke, said areas having different resiliencies. To this end, the magnetic-chamber base, designed so as to be capable of vibrating, has a supporting strip whose ends act as magnet-supporting areas.

9 Claims, 5 Drawing Sheets

HOUSING FOR SWITCHGEARS

FIELD OF THE INVENTION

The present invention relates to a switchgear housing for an electromagnetic switching device which has a magnetic chamber which includes a magnet yoke and a magnet armature, two magnet-supporting areas having different elastic resiliencies existing at the magnetic-chamber base of the switchgear housing to support the magnet yoke.

BACKGROUND INFORMATION

In a conventional switchgear housing for a conventional contactor.

The magnet yoke of the magnetic system is supported on a firm point of support and a point of support which is soft relative to said firm point, in order to damp, as well as possible, impact-vibration processes as they occur in response to the closing of an a.c. solenoid as a result of relatively high closing speeds. Because of the impact vibrations, the magnet armature with the contact carrier can rebound into the "OFF" position. In conventional methods heretofore, attempt was made to solve this problem by the two variably flexible points of support, by which the translatory motion is partly transformed into a rotatory motion.

SUMMARY OF THE INVENTION

An object of the present invention is to design a switchgear housing so that a rebound of the magnet armature is reduced in a simple and, at the same time, effective manner.

The objective of the present invention is achieved in that the magnetic-chamber base is designed so as to be capable of vibrating and, on its surface facing the interior of the switchgear housing, has a supporting strip whose ends act as magnet-supporting areas, a first magnet-supporting area being retained at the one end exclusively by the magnetic-chamber base.

It is especially advantageous if the second magnet-supporting area is ribbed with enclosed frame profiles, thus realizing a firmly flexible magnet-supporting area in a simple manner. If an insert rubber is inserted between the magnet yoke and the supporting strip, it is possible to particularly influence the elastic quality of the soft magnet-supporting area, dependent on the height of the supporting strip.

Problems with creepage distances and clearances between the magnetic system and the bottom side of the switchgear housing used for mounting purposes are ruled out because the magnetic-chamber base is enclosed.

DETAILED DESCRIPTION OF THE INVENTION

Figure 1:
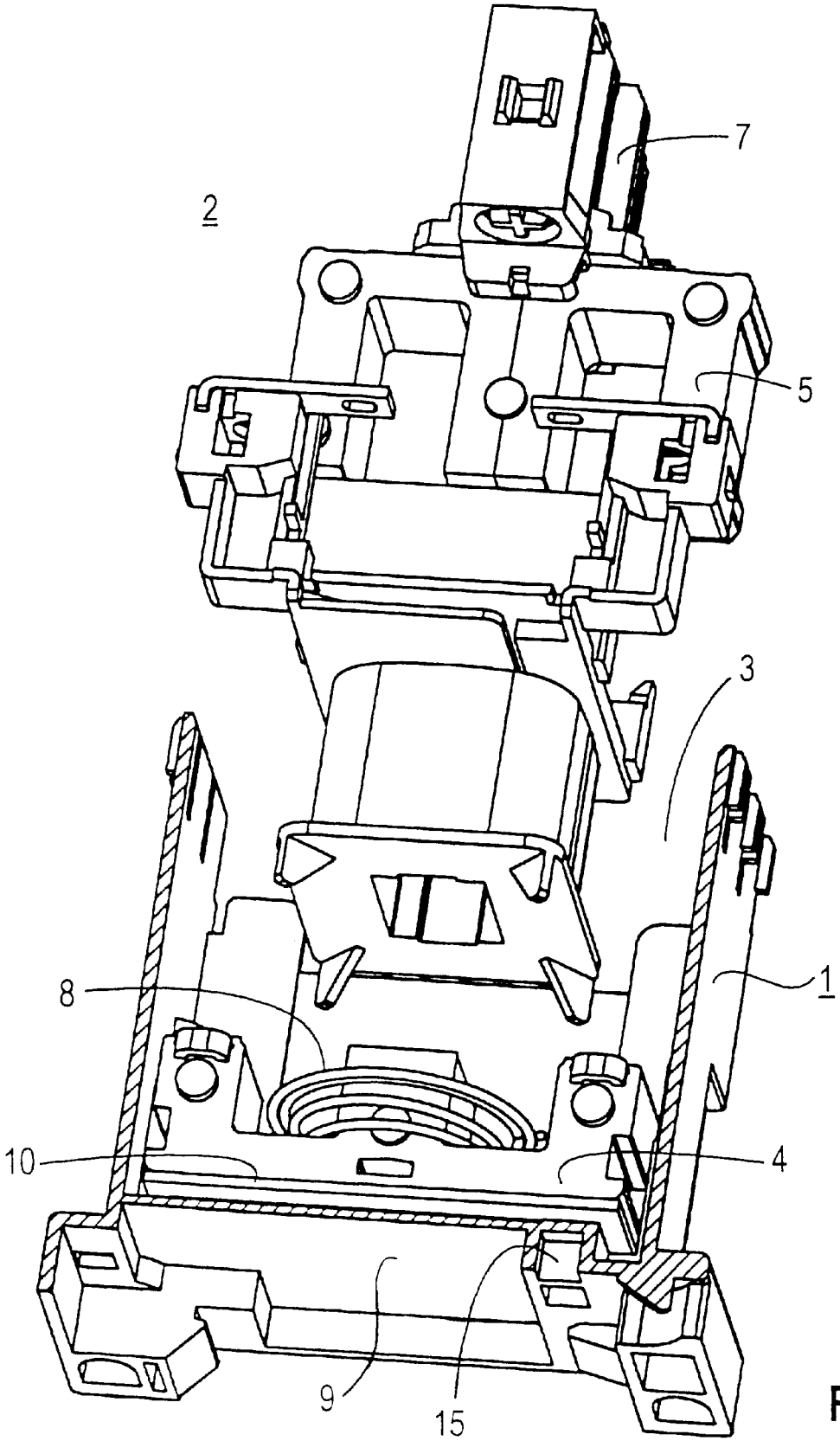
FIG. 1 shows a magnetic system in a contactor housing according to the present invention.

FIG. 1 shows a switchgear housing 1 having an a.c. magnetic system for an electromagnetic switching device. In the exemplary embodiment of the present invention, housing 1 is a housing for a contactor 2, in whose magnetic chamber 3 the magnetic system is accomodated. The magnetic system is composed essentially of a magnet yoke 4, a magnet armature 5, a coil 6 having coil connections, a contact carrier 7 and a conical spiral spring 8. The magnetic system is supported with its magnet yoke 4 at magnetic-chamber base 9 of contactor housing 1, with the intermediate layer of an insert rubber 10. In this context, magnetic-chamber base 9 is formed having two magnet-supporting areas 11,12 (not shown here) having different resiliencies. The one magnet-supporting area 11 exhibits a soft resilience, the other magnet-supporting area 12 exhibits a relatively firm resilience (see FIG. 3).

Figure 2:
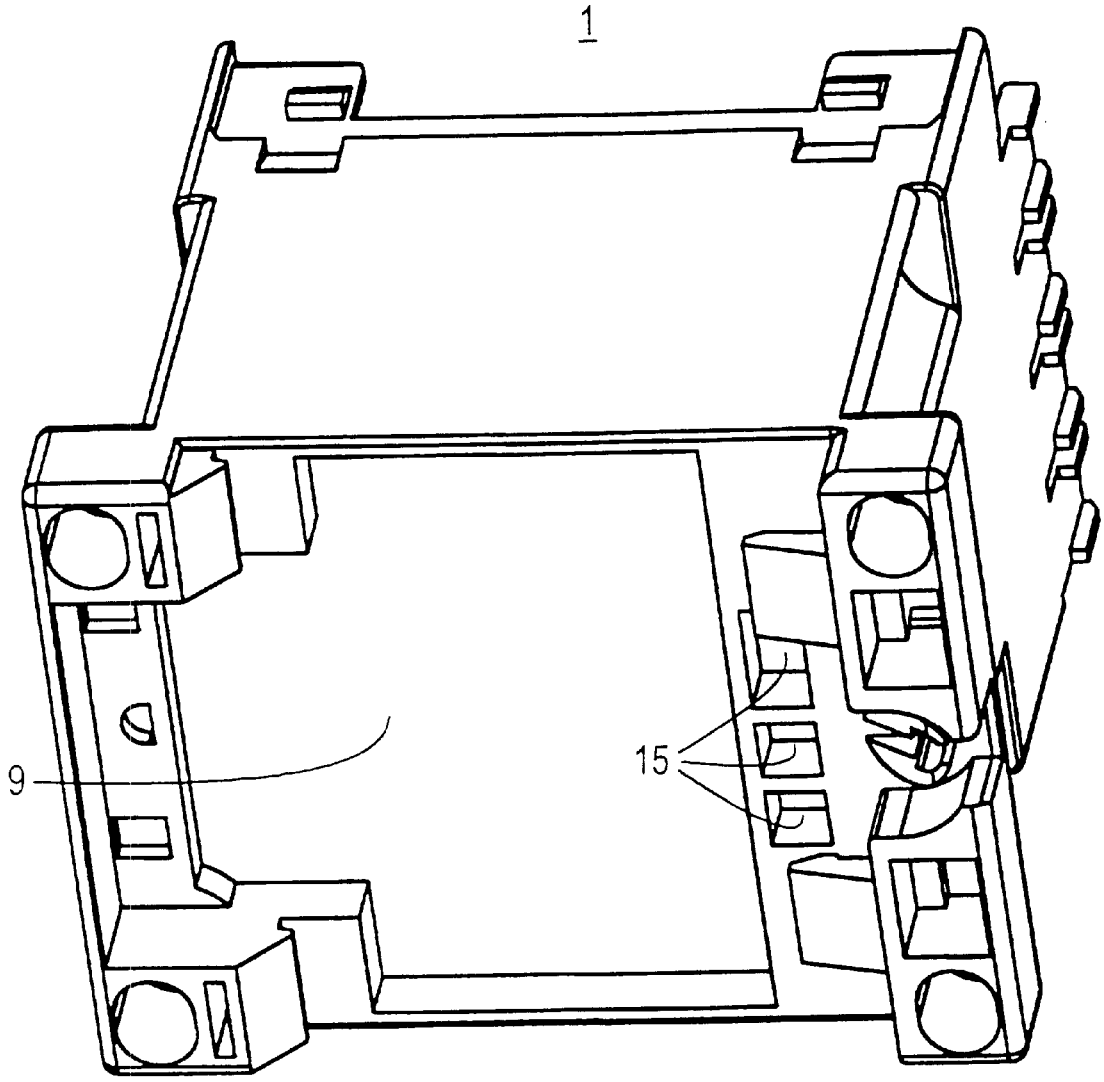
FIG. 2 shows a perspective of a side view of the contactor housing having a magnetic-chamber base.
Figure 3:
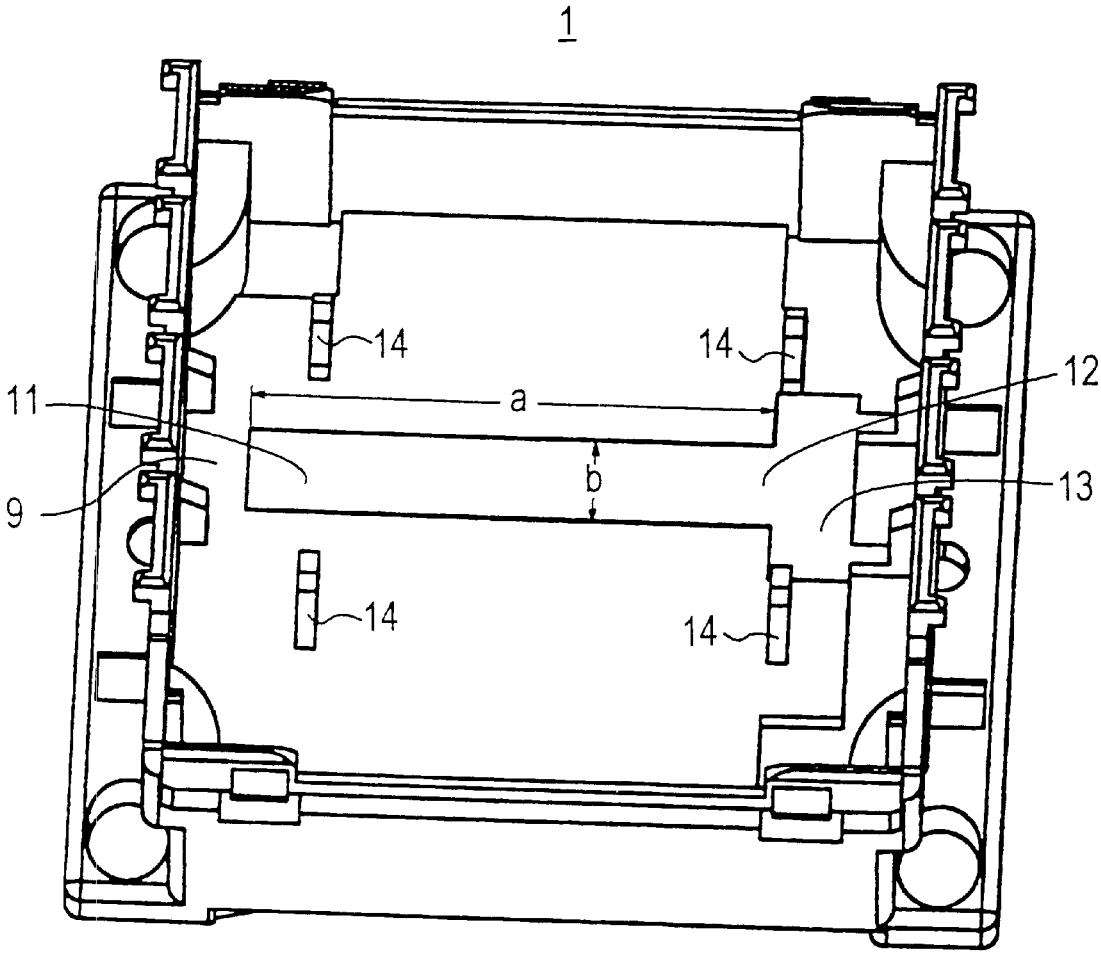
FIG. 3 shows an inside view of the contactor housing according to FIG. 2 with the magnetic-chamber base.

FIG. 2 shows the bottom side of contactor housing 1 with enclosed magnetic-chamber base 9 and frame profiles 15. FIG. 3 shows an interior view of contactor housing 1 with magnetic-chamber base 9. Magnet-supporting areas 11,12 are formed on the inner side of magnetic-chamber base 9 as a supporting strip whose one end is enclosed all round by magnetic-chamber base 9, and whose other end changes into a broad, reinforced area 13. These two ends are used as magnet-supporting areas 11,12 having the soft and firm resilience already mentioned. Four ribs 14 jutting out at magnetic-chamber base 9 are used for the lateral guidance of magnet yoke 4. Magnetic-chamber base 9 is relatively thin-walled. Soft magnet-supporting area 11 of the supporting strip is completely encircled by magnetic-chamber base 9, which on the other hand is joined with the greatest possible clearance to the walls of contactor housing 1. The other, firm magnet-supporting area 12 is ribbed with enclosed frame profiles 15 according to FIG. 2. A broad magnet support is provided by broad area 13 for magnet yoke 4 on the firm supporting side, while on the soft supporting side, there is a narrow, not quite traversing magnet support.

Contactor housing 1 described above is optimized with respect to rebound by the special construction of magnetic-chamber base 9. This means that the impact-vibration processes, which result because of the relatively high closing speed when closing an a.c. solenoid, are cushioned extremely well, without magnet armature 5 with contact carrier 7 (see FIG. 1) rebounding significantly into the "OFF" position.

Magnetic-chamber base 9 is completely enclosed toward the bottom, thereby ruling out from the start possible problems with creepage distances and clearances between coil 6 and the lower side of contactor housing 1 used as the mounting plane.

Figure 4:
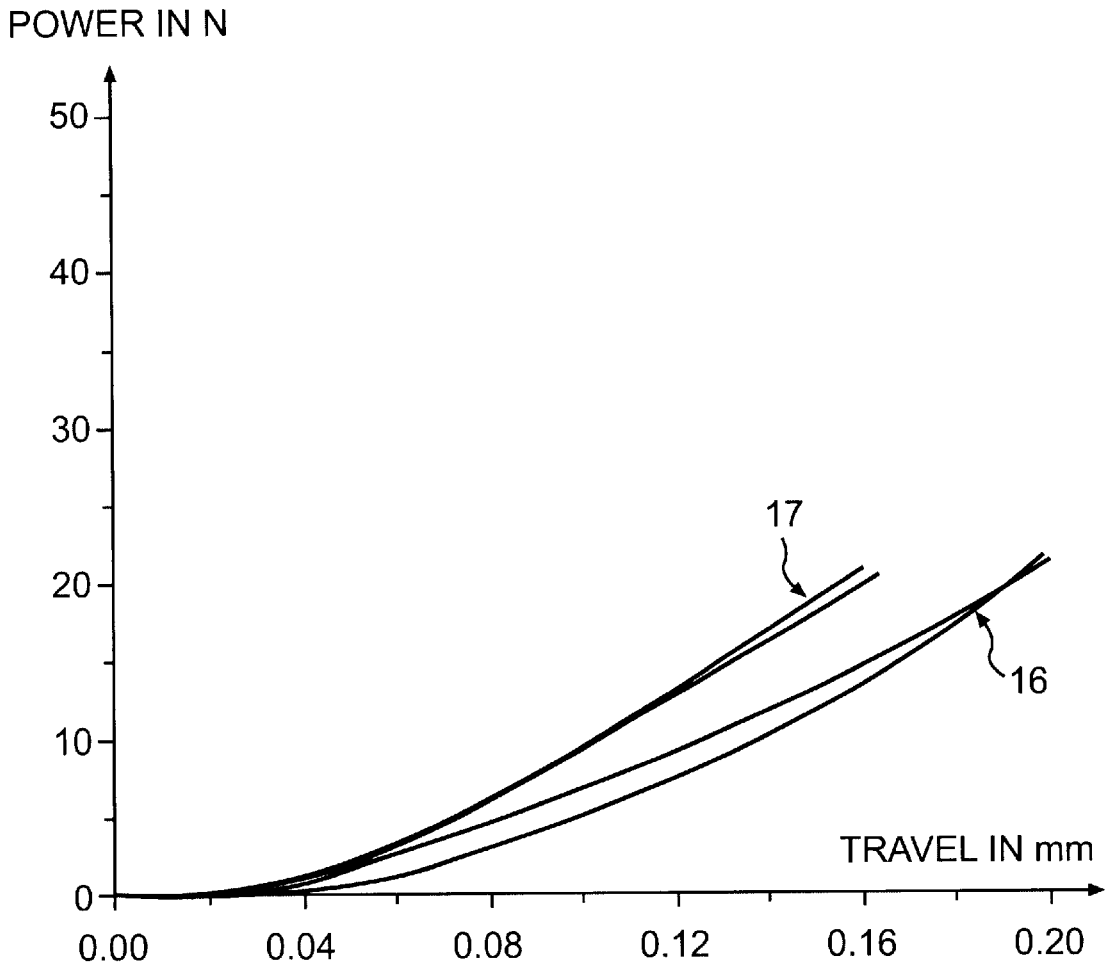
FIG. 4 shows a spring characteristic of the magnetic-chamber base.

The effectiveness of contactor housing 1 described above is owing to the following technical measures. The very thin magnetic-chamber base 9, joined all-round, and soft supporting area 11 result in a progressive spring characteristic. Because of this, the damping component due to contactor housing 1 is not as strongly temperature- and moisture-dependent as, for example, a flexible free carrier having a linear characteristic curve. This is primarily because of the elasticity property, dependent on the temperature and the moisture content, of the plastic used in this case. Insert rubber 10 has the following influence on the damping effect. In the stationary state, it is supported, i.e. it rests on soft supporting area 11, and after its spring deflection, comes to rest over a large surface on magnetic-chamber base 9. FIG. 4 shows spring characteristics 16, 17 to represent the elastic properties of magnetic-chamber base 9. Spring characteristics 16 lying below show in principle the effect when insert rubber 10 is inserted, upper spring characteristics 17 show the effect when dispensing with such an insert. Initially, spring characteristics 16, 17 have a relatively flat profile and then rise progressively, i.e. with increasing spring excursion or greater deflection, the power requirement grows disproportionally.

The damping components rising disproportionally in the progressive range of the spring characteristics yield a damping system which covers very well the closing speed range that is a function of the operating voltage, the phase angle, the temperature and further influence parameters.

Figure 5:
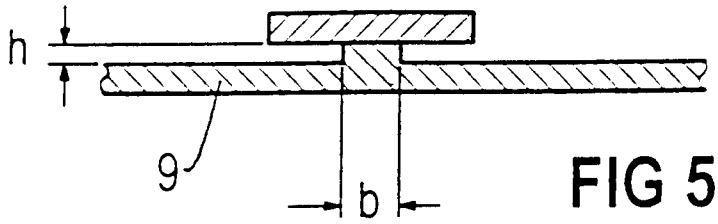
FIG. 5 shows an exemplary supporting strip.
Figure 6:
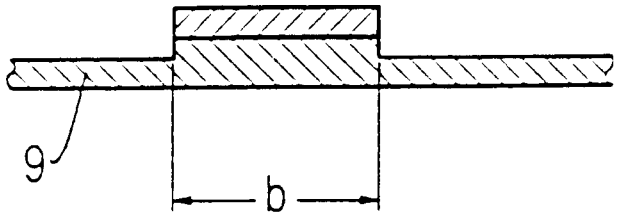
FIG. 6 shows another exemplary supporting strip.
Figure 7:
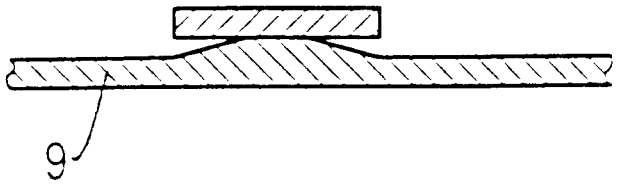
FIG. 7 shows yet another exemplary supporting strip.

The spring action can be adapted to the desired damping by variable formation of the supporting strip with regard to its length a, its width b and its offset height h. FIGS. 5, 6 and 7 show different formation possibilities. FIGS. 5 and 6 show embodiments of the supporting strip with a different width b. In FIG. 7, the supporting strip is provided with a sloping transition.

Although the present invention is explained with reference to the specific exemplary embodiment shown in the attached drawings, it should be taken into account that the intention is not to thereby restrict the present invention only to the specific exemplary embodiment shown, but rather to include all possible changes, modifications and equivalent arrangements, in so far as they are covered by the contents of the patent claims.

What is claimed is:

1. A switchgear housing for an electromagnetic switching device including a magnet yoke and a magnet armature, comprising:

a magnetic chamber including a vibratable magnetic-chamber base, the magnetic-chamber base having a surface including a supporting strip, the surface facing an interior space of the switchgear housing, the supporting strip including a first end configured as a first magnet-supporting area and a second end configured as a second magnet-supporting area, the first magnet-supporting area having a first elastic resiliency and the second magnet-supporting area having a second elastic resiliency, the first elastic resiliency being different from the second elastic resiliency, the first magnet-supporting area being retained at the first end only by the magnetic-chamber base;

wherein the first magnet-supporting area and the second magnet-supporting area support the magnet yoke, and the magnet armature is positionable in the magnetic chamber.

2. The switchgear housing according to claim 1, wherein the second end of the supporting strip includes the second magnet-supporting area having a first stiffness characteristic and a further section of the supporting strip having a second stiffness characteristic, the first stiffness characteristic being greater than the second stiffness characteristic.

3. The switchgear housing according to claim 1, wherein the second magnet-supporting area is ribbed with a plurality of enclosed frame profiles.

4. The switchgear housing according to claim 1, further comprising:

a rubber insert positioned between the magnet yoke and the supporting strip.

5. The switchgear housing according to claim 1, wherein the magnetic-chamber base is enclosed.

6. The switchgear housing according to claim 1, wherein the first magnet-supporting area has a progressive spring characteristic.

7. The switchgear housing according to claim 1, wherein, by changing at least one of a length, a width, and a height of the supporting strip, a damping property of the magnetic-chamber base is adjusted.

8. The switchgear housing according to claim 7, wherein the damping property of the magnet-chamber base is adjusted by shaping the supporting strip.

9. The switchgear housing according to claim 8, wherein the supporting strip is shaped with a transitioning slope.

* * * * *